US009994992B2

(12) United States Patent
Kim et al.

(10) Patent No.: US 9,994,992 B2
(45) Date of Patent: Jun. 12, 2018

(54) WASHING MACHINE

(71) Applicant: SAMSUNG ELECTRONICS CO., LTD., Suwon-si, Gyeonggi-do (KR)

(72) Inventors: Young-Hyun Kim, Suwon-si (KR); Geun Kang, Hwaseong-si (KR); Jong Woon Park, Hwaseong-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 392 days.

(21) Appl. No.: 14/608,896

(22) Filed: Jan. 29, 2015

(65) Prior Publication Data

US 2015/0211164 A1 Jul. 30, 2015

(30) Foreign Application Priority Data

Jan. 29, 2014 (KR) ..... 10-2014-0011614
Jan. 28, 2015 (KR) ..... 10-2015-0013635

(51) Int. Cl.
*D06F 17/08* (2006.01)
*D06F 29/00* (2006.01)
(Continued)

(52) U.S. Cl.
CPC ..... *D06F 39/14* (2013.01); *D06F 29/00* (2013.01); *D06F 37/40* (2013.01); *D06F 17/08* (2013.01);
(Continued)

(58) Field of Classification Search
CPC ..... D06F 17/08; D06F 29/00; D06F 37/40; D06F 39/005; D06F 39/12; D06F 39/125; D06F 39/14
(Continued)

(56) References Cited

U.S. PATENT DOCUMENTS 6,006,553 A * 12/1999 Lee ..... D06F 37/304 68/133
2002/0042957 A1 4/2002 Kim et al.
(Continued)

FOREIGN PATENT DOCUMENTS

JP 10-211397 8/1998
KR 1996-0034529 10/1996
(Continued)

OTHER PUBLICATIONS

International Search Report dated May 8, 2015 in corresponding International Patent Application No. PCT/KR2015/000965.

*Primary Examiner* — Levon J Shahinian
(74) *Attorney, Agent, or Firm* — Staas & Halsey LLP

(57) ABSTRACT

Disclosed herein is a washing machine, which includes a clutch unit provided to be able to selectively transmit power generated from a drive unit to a drum and a pulsator. The clutch unit includes an outer shaft that is connected to the drum at an upper side thereof and rotates the drum, an inner shaft that is located in the outer shaft, is connected to the pulsator at an upper side thereof, and rotates the pulsator, and a one-way bearing that is installed between the inner shaft and the outer shaft. The one-way bearing selectively transmits a rotating force from the outer shaft to the inner shaft according to a rotating direction of the outer shaft. With this configuration, it is possible to simplify a structure of the clutch unit and to use space efficiently.

21 Claims, 14 Drawing Sheets

(51) Int. Cl.

| | |
|---|---|
| ***D06F 37/40*** | (2006.01) |
| ***D06F 39/00*** | (2006.01) |
| ***D06F 37/12*** | (2006.01) |
| ***D06F 39/14*** | (2006.01) |
| *D06F 39/12* | (2006.01) |

(52) U.S. Cl.
CPC ..... *D06F 39/005* (2013.01); *D06F 39/12* (2013.01); *D06F 39/125* (2013.01)

(58) Field of Classification Search
USPC ..... 68/12.02, 23.3, 23.6, 133, 208, 210
See application file for complete search history.

(56) References Cited

U.S. PATENT DOCUMENTS

| | | | | |
|---|---|---|---|---|
| 2006/0042022 | A1* | 3/2006 | Kim | D06F 37/304 8/159 |
| 2009/0072684 | A1 | 3/2009 | Woo et al. | |
| 2009/0126419 | A1* | 5/2009 | Yoon | D06F 39/005 68/212 |
| 2009/0320371 | A1* | 12/2009 | Hill | D06F 39/14 49/13 |

FOREIGN PATENT DOCUMENTS

| | | |
|---|---|---|
| KR | 1999-0084877 | 12/1999 |
| KR | 10-2007-0003527 | 1/2007 |
| KR | 10-0822153 | 4/2008 |

* cited by examiner

WASHING MACHINE

CROSS-REFERENCE TO RELATED APPLICATION(S)

This application claims the benefit of Korean Patent Application No. 10-2014-0011614, filed on Jan. 29, 2014, and of Korean Patent Application No. 10-2015-0013635, filed Jan. 28, 2015, in the Korean Intellectual Property Office, the disclosures of which are incorporated herein by reference.

BACKGROUND

1. Field

Embodiments of the present invention relate to a washing machine, and more particularly, to a washing machine equipped with a clutch configured to selectively transmit power of a drive unit to a drum and a pulsator.

2. Description of the Related Art

Washing machines are machines that wash laundry using electric power, and generally include a tub that stores wash water, a drum that is rotatably installed in the tub, a pulsator that is rotatably installed on a bottom of the drum, a drive unit that rotates the drum and the pulsator, and a clutch that allows a rotating force to be selectively transmitted to the drum according to washing or water extracting.

When the drum and the pulsator are rotated with the laundry, detergent, and the wash water that are put into the drum, the pulsator agitates the laundry put into the drum along with the wash water, and removes dirt attached to the laundry.

The clutch mounted on the washing machine is configured to be connected to the drum and the pulsator and to selectively transmit power generated from a motor to the drum and the pulsator. A type of the clutch depends on a type of the washing machine, for instance a capacity of the laundry.

SUMMARY

Therefore, it is an aspect of the present invention to provide a washing machine including a clutch unit that selectively transmits a rotating force to a drum and a pulsator using a one-way bearing.

Additional aspects of the invention will be set forth in part in the description which follows and, in part, will be obvious from the description, or may be learned by practice of the invention.

In accordance with a first aspect of the present invention, a washing machine includes: a main body; a tub that is disposed in the main body so as to store wash water; a drum that is rotatably disposed in the tub; a pulsator that is rotatably disposed in the drum; a drive unit that is provided below the tub so as to generate power for rotating the drum and the pulsator; and a clutch unit that is disposed between the drive unit and the drum. The clutch unit includes: an outer shaft that is connected to the drum at an upper side thereof and rotates the drum; an inner shaft that is located in the outer shaft, is connected to the pulsator at an upper side thereof, and rotates the pulsator; and a one-way bearing that is installed between the inner shaft and the outer shaft. The one-way bearing selectively transmits a rotating force from the outer shaft to the inner shaft according to a rotating direction of the outer shaft.

The one-way bearing may be provided such that only any one of the inner shaft and the outer shaft is rotated when the drive unit is rotated in a first direction, and both the inner shaft and the outer shaft are rotated when the drive unit is rotated in a second direction.

The outer shaft may be connected to the drive unit at a lower end thereof.

The inner shaft may come into contact with the one-way bearing and may be supplied with the rotating force from the one-way bearing.

The clutch unit may further include a clutch housing having an internal space, and the inner shaft and the outer shaft may be located in the clutch housing.

The clutch unit may further include at least one ball bearing installed between the clutch housing and the outer shaft.

In accordance with a second aspect of the present invention, a washing machine includes: a main body; a tub that is disposed in the main body so as to store wash water; a drum that is rotatably disposed in the tub; a pulsator that is rotatably disposed in the drum; a drive unit that is provided below the tub so as to generate power for rotating the drum and the pulsator; and a clutch unit that is disposed between the drive unit and the drum. The clutch unit includes: an outer shaft that rotates the drum; an inner shaft that is located in the outer shaft and rotates the pulsator; and a one-way bearing that is installed between the inner shaft and the outer shaft. The one-way bearing transmits or blocks a rotating force of the drive unit to the inner shaft according to a rotating direction of the outer shaft.

The outer shaft may be connected to the drum at an upper side thereof and to the drive unit at a lower side thereof.

The one-way bearing may not transmit a rotating force of the outer shaft to the inner shaft when the drive unit is rotated in a first direction, and transmit the rotating force of the outer shaft to the inner shaft when the drive unit is rotated in a second direction.

In accordance with a third aspect of the present invention, a washing machine includes: a main body configured to have a plurality of cabinets; a plurality of tubs configured to have first and second tubs provided in the respective cabinets so as to store wash water; a plurality of drums configured to have first and second drums rotatably disposed in the respective tubs; a pulsator rotatably disposed in any one of the drums; a drive unit configured to generate power for rotating the any one of the drums and the pulsator; and a clutch unit configured to selectively transmit the power from the drive unit to the any one of the drums and the pulsator. The clutch unit includes: a plurality of rotating shafts having an outer shaft that is connected to the any one of the drums at one side thereof and rotates the any one of the drums and an inner shaft that is located in the outer shaft, is connected to the pulsator at the one side thereof, and rotates the pulsator; and a one-way bearing that transmits a rotating force from any one of the rotating shafts to the other according to a rotating direction of the any one of the rotating shafts.

The one-way bearing may be provided such that the plurality of rotating shafts are rotated together when the drive unit is rotated in a first direction, and only the any one of the rotating shafts is rotated when the drive unit is rotated in a second direction opposite to the first direction.

The one-way bearing may be disposed between the inner shaft and the outer shaft.

The outer shaft may be connected to the drive unit so as to be supplied with the power from the drive unit, and the one-way bearing may transmit the rotating force from the outer shaft to the inner shaft according to a rotating direction of the drive unit.

The one-way bearing may be provided such that only the outer shaft is rotated when the drive unit is rotated in a first direction, and both the outer shaft and the inner shaft are rotated when the drive unit is rotated in a second direction opposite to the first direction.

The washing machine may be provided to operate in a washing mode in which the drive unit is alternately rotated in the first direction and the second direction, and in a water extracting mode in which the drive unit is rotated in the second direction.

The plurality of cabinets may include: an upper cabinet in which the first tub and the first drum are disposed and at an upper portion of which a first opening is formed for withdrawing laundry; and a lower cabinet in which the second tub and the second drum are disposed, which is provided under the upper cabinet, and in a lateral portion of which a second opening is formed for withdrawing laundry.

The washing machine may further include a vibration reduction unit that has at least one elastic unit so as to attenuate vibration and provided between the upper cabinet and the lower cabinet.

The at least one elastic unit may include: a support part connected to a lower portion of the upper cabinet; and an elastic part that is provided at a lower portion of the support part and is elastically supported on an upper surface of the lower cabinet.

The upper cabinet may further include a reflector that is provided adjacent to the first opening to provide a view of the laundry in the first drum from outside of the upper cabinet.

The washing machine may further include a laundry tray that is provided on the main body for placing laundry thereon.

The laundry tray may be provided to be able to be withdrawn with respect to the main body.

In accordance with a fourth aspect of the present invention, a washing machine includes: a main body configured to have an upper cabinet and a lower cabinet; first and second tubs provided in the respective upper and lower cabinets so as to store wash water; first and second drums rotatably disposed in the respective first and second tubs; a pulsator rotatably disposed in the first drum; a drive unit provided below the first tub and configured to generate power for rotating the first drum and the pulsator; and a clutch unit configured to selectively transmit the power from the drive unit to the first drum and the pulsator, the clutch unit being provided such that the first drum and the pulsator are rotated together when the drive unit is rotated in a first direction and only the first drum is rotated when the drive unit is rotated in a second direction opposite to the first direction. The washing machine is provided to operate in a washing mode in which the drive unit is alternately operated in the first direction and the second direction, and in a water extracting mode in which the drive unit is operated in the first direction only.

BRIEF DESCRIPTION OF THE DRAWINGS

These and/or other aspects of the invention will become apparent and more readily appreciated from the following description of the embodiments, taken in conjunction with the accompanying drawings of which.

DETAILED DESCRIPTION

Figure 1:
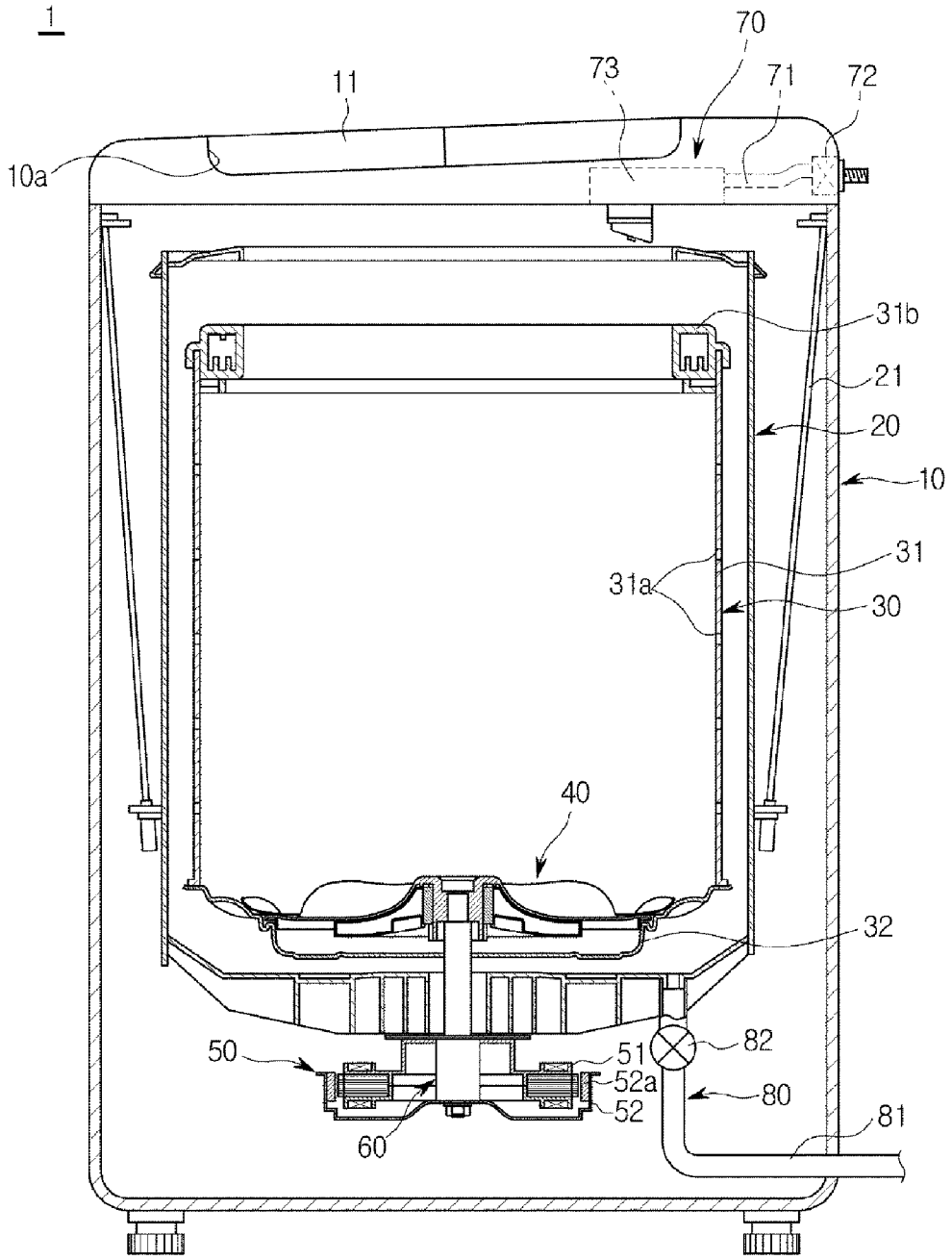
FIG. 1 is a cross-sectional view illustrating a configuration of a washing machine according to a first embodiment of the present invention.

Reference will now be made in detail to exemplary embodiments of the present invention, examples of which are illustrated in the accompanying drawings, wherein like reference numerals refer to like elements throughout.

FIG. 1 is a cross-sectional view illustrating a configuration of a washing machine according to a first embodiment of the present invention.

As illustrated in FIG. 1, a washing machine 1 may include a main body 10, a tub 20, a drum 30, a pulsator 35, a drive unit 50, a clutch unit 60, a feed unit 70, and a drain unit 80.

The main body 10 forms an exterior of a washing machine 1. The main body 10 includes an opening 10*a* and a door 11. The opening 10*a* is formed in an upper surface of the main body 10. The opening 10*a* serves as a passage through which a user can put laundry into the drum 30. The door 11 is rotatably installed on an upper rear end of the main body 10. The door 11 is rotated to open/close the opening 10*a*.

The tub 20 is installed in the main body 10 in a suspended state, and contains water to be used for washing. The tub 20 is suspended and supported on the main body 10 by suspension units 21 connecting a lower outer surface of the tub 20 and an inner upper portion of the main body 10. The suspension units 21 attenuate vibration generated from the main body 10 or the tub 20 during the washing or during water extracting.

The feed unit 70 is disposed at an upper portion of the tub 20. The feed unit 70 feeds wash water to the tub 20. The feed unit 70 includes a feed pipe 71 and a feed valve 72.

The feed pipe 51 is connected to an external water supply source (not shown) at one side thereof and a detergent supply unit 73 at the other side thereof. Water fed through the feed pipe 51 is fed into the tub 20 via the detergent supply unit 73 along with detergent. The feed valve 72 is installed on the feed pipe 71 so as to control the supply of the water.

The drain unit 80 is disposed below the tub 20. The drain unit 80 drains away the water used for the washing. The drain unit 80 includes a drain pipe 81 and a drain valve 82.

The drain pipe 81 is connected to a lower portion of the tub 20, and guides the water of the tub 20 to be drained away. The drain valve 82 is disposed on the drain pipe 81 and opens/closes the drain pipe 81.

The drum 30 is located inside the tub 20. The drum 30 is formed in a cylindrical shape in which an upper portion thereof is open. The drum 30 has a plurality of through-holes 31*a* formed in a sidewall thereof. An internal space of the drum 30 and an internal space of the tub 20 communicate with each other through the plurality of through-holes 31*a* of the drum 30. The through-holes 31*a* allow the water of the tub 20 to flow into the drum 30 and simultaneously allow the water of the drum 30 to flow into the tub 20.

The drum 30 may be mounted with a balancer 31*b* at the upper portion thereof. The balancer 31*b* offsets an unbalanced load occurring at the drum 30 when the drum 30 is rotated at a high speed such that the drum 30 can be stably rotated.

A lower surface 32 of the drum 30 may be connected to an outer shaft 62 of the clutch unit 60 to be described below. The drum 30 may be supplied with a rotating force from the outer shaft 62, and be rotated in a first direction w1 or in a second direction w2. Hereinafter, the first direction w1 is defined as a clockwise direction, and the second direction w2 is defined as a counterclockwise direction.

The pulsator 35 is installed inside the drum 30. The pulsator 35 may be installed on an inner bottom of the drum 30. The pulsator 35 is connected to an inner shaft 63 of the clutch unit 60 to be described below. The pulsator 35 may be supplied with a rotating force from the inner shaft 63 and be rotated together with the inner shaft 63. The pulsator 35 may generate a stream of water at the wash water inside the drum 30 while being rotated together with the inner shaft 63. The pulsator 35 may generate the stream of water at the wash water inside the drum 30 by means of relative motion with respect to the drum 30. The generated stream of water may wash the laundry in the drum 30. Further, the pulsator 35 may extract water from the laundry while being rotated together with the drum 30.

According to the first embodiment of the present invention, the pulsator 35 may be rotated in one direction only. The pulsator 35 may be selectively supplied with only a one-way rotating force from the clutch unit 60 to be described below.

The drive unit 50 is disposed below the tub 20. The drive unit 50 is supplied with power and generates a driving force. The drive unit 50 may generate the driving force in the first direction w1 or the second direction w2. According to an example, the drive unit 50 may include a motor. To be specific, the drive unit 50 is provided to be rotatable in the first direction w1 or the second direction w2.

The drive unit 50 may be configured to include a stator 51 having a coil 51*a* and a rotor 52 rotated by an interaction with the stator 51 in addition to magnets 52*a* interacting with the coil 51*a*.

The drive unit 50 is connected to the clutch unit 60. The drive unit 50 transmits the generated driving force to the clutch unit 60. A rotating force generated from the drive unit 50 may be selectively transmitted to both or one of the drum 30 and the pulsator 35 through the clutch unit 60.

The clutch unit 60 is disposed between the drive unit 50 and the tub 20. The clutch unit 60 may selectively transmit the rotating force of the drive unit 50 to the tub 20 and the pulsator 35. Hereinafter, the clutch unit 60 will be described in detail.

Figure 2:
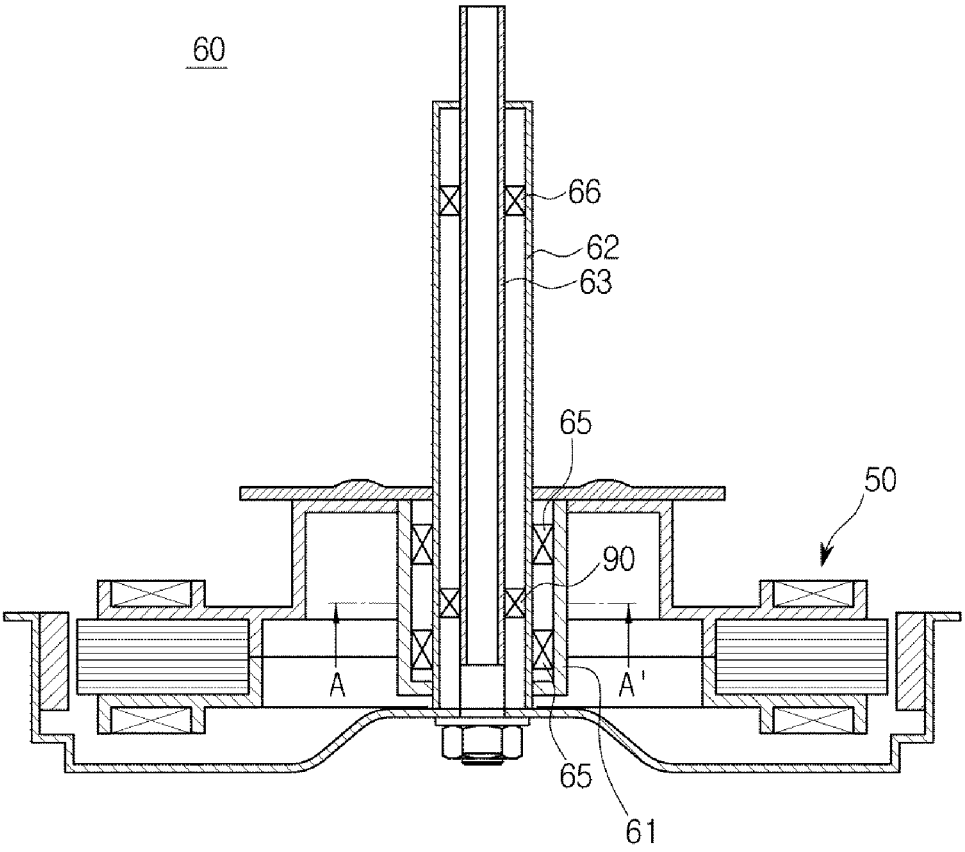
FIG. 2 is a view illustrating a cross section of a clutch unit in the washing machine of FIG. 1 according to the first embodiment of the present invention.

FIG. 2 is a view illustrating a cross section of the clutch unit in the washing machine of FIG. 1 according to the first embodiment of the present invention.

Referring to FIG. 2, the clutch unit 60 according to the first embodiment of the present invention may include a clutch housing 61, an outer shaft 62, an inner shaft 63, a first bearing 65, a second bearing 66, and a one-way bearing 90.

The clutch housing 61 may be located inside the drive unit 50. The clutch housing 61 may be provided in a cylindrical shape having an internal space. The clutch housing 61 may be provided in a shape having holes through which the outer and inner shafts 62 and 63 pass in upper and lower surfaces thereof. The clutch housing 61 may provide a space in which the outer shaft 62 and the inner shaft 63 are located inside the drive unit 50.

The first bearing 65 may be located between the clutch housing 61 and the outer shaft 62. The first bearing 65 may support the outer shaft 62 located inside the clutch housing 61. The first bearing 65 may be provided to allow the outer shaft 62 to be rotated in the clutch housing 61. A plurality of first bearings 65 may be provided in the clutch housing 61 at regular intervals. According to an example, the first bearing 65 may be provided as a ball bearing.

According to the first embodiment of the present invention, the outer shaft 62 connects the drum 30 and the drive unit 50. The outer shaft 62 is connected to the drum 30 at one side thereof and the drive unit 50 at the other side thereof. Thereby, the outer shaft 62 can directly transmit the rotating force generated from the drive unit 50 to the drum 30.

The outer shaft 62 may be formed as a cylindrical shaft whose interior is hollow. The inner shaft 63, the second bearing 66, and the one-way bearing 90 may be located in the hollow of the outer shaft 62.

The inner shaft 63 is located in the hollow of the outer shaft 62. The inner shaft 63 may be formed as a cylindrical shaft whose interior is hollow. The inner shaft 63 may be provided in such a way that an upper end thereof protrudes upward relative to an upper end of the outer shaft 62. One side of the inner shaft 63 may be connected to the pulsator 35. The inner shaft 63 may transmit the rotating force of the drive unit 50 to the pulsator 35.

The second bearing 66 may be disposed between the inner shaft 63 and the outer shaft 62. The second bearing 66 may support the inner shaft 63 and the outer shaft 62. Further, the second bearing 66 may be provided to allow the inner shaft 63 and the outer shaft 62 to be separately rotated. According to an example, the second bearing 66 may be provided as an oilless bearing.

According to an example, the one-way bearing 90 may be installed between the inner shaft 63 and the outer shaft 62. The inner shaft 63 may be supplied with the rotating force of the drive unit 50 from the one-way bearing 90. The one-way bearing 90 may selectively transmit a rotating force of the outer shaft 62 to the inner shaft 63.

Figure 3:
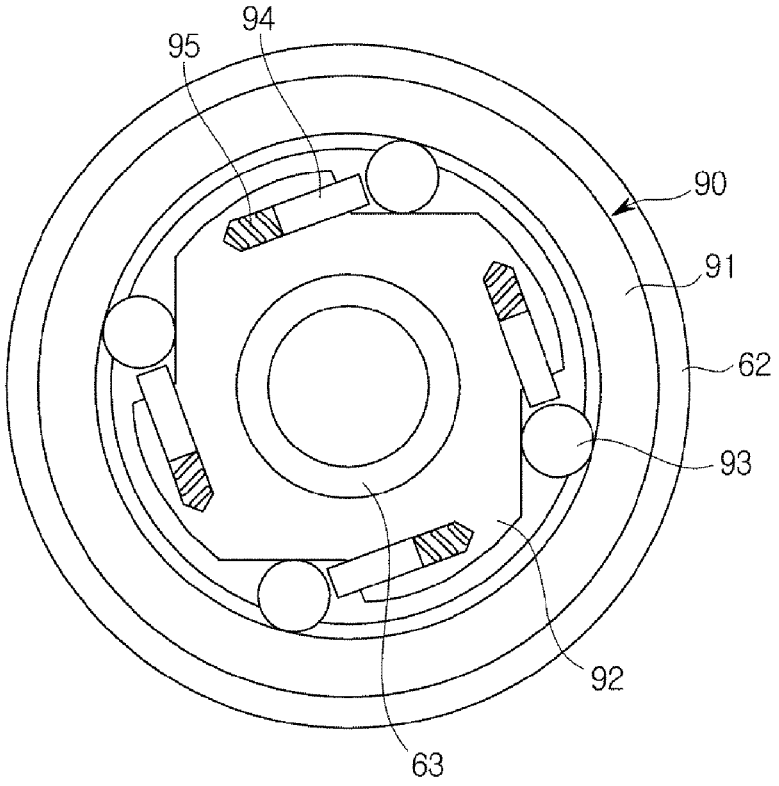
FIG. 3 is a cross-sectional view taken along line A-A' of FIG. 2.

FIG. 3 is a cross-sectional view of the clutch unit including the one-way bearing when viewed along line A-A' of FIG. 2.

Referring to FIG. 3, the one-way bearing 90 may include an outer plate 91, an inner plate 92, a roller 93, and a plunger 94.

The outer plate 91 may be provided in a ring shape having a hollow. According to an example, the outer plate 91 may be installed in such a way that an outer surface thereof is press-fitted into an inner surface of the outer shaft 62. As a result, the outer plate 91 can be rotated in the first direction w1 or in the second direction w2 along with the outer shaft 62.

The inner plate 92 may be located inside the outer plate 91. The inner plate 92 may be provided in a shape having a hollow. The inner plate 92 may be fixed in such a way that the inner shaft 63 is press-fitted into the hollow thereof. Thus, the inner plate 92 may be rotated along with the inner shaft 63.

The inner plate 92 may be provided with a recess in an outer surface thereof. The recess of the inner plate 92 may provide a space in which the roller 93 is rolled. The roller 93 may be rolled on one side of the recess of the inner plate 92. To this end, the one side of the recess of the inner plate 92 may be provided in a flat shape. The other side of the recess of the inner plate 92 may be provided to have a sharp inclination so as to be able to restrict the rolling of the roller 93.

A plurality of recesses may be formed in the outer surface of the inner plate 92 at regular intervals. Thus, a space between the outer surface of the inner plate 92 and the inner surface of the outer plate 91 may be variably provided. In detail, the deeper a depth of the recess of the outer surface of the inner plate 92, the wider the space between the outer plate 91 and the inner plate 92.

The roller 93 may be located between the inner plate 92 and the outer plate 91. The roller 93 may be located in the recess of the outer surface of the inner plate 92. A plurality of rollers 93 may be provided. The rollers 93 may be provided to be equal in number to the recesses provided for the outer surface of the inner plate 92.

The roller 93 can be rolled due to friction with the inner surface of the outer plate 91 while the outer plate 91 is rotated. The roller 93 may move leftward/rightward while being rolled in the recesses of the inner plate 92. In detail, the roller 93 may move rightward when the outer plate 91 is rotated in the first direction w1, and leftward when the outer plate 91 is rotated in the second direction w2.

The roller 93 may be provided to allow the outer plate 91 and the inner plate 92 to be rotated together in the same direction. To be specific, when the roller 93 moves in the recess of the inner plate 92 to a region in which a space between the outer plate 91 and the inner plate 92 has a smaller volume than the roller 93, the roller 93 may come into contact with the outer plate 91 and the inner plate 92. Here, the roller 93 is restrained between the outer plate 91 and the inner plate 92, and may transmit a rotating force of the outer plate 91 to the inner plate 92. In this case, the outer plate 91, the inner plate 92, and the roller 93 can be rotated together in the same direction.

According to an example, when the outer plate 91 is rotated in the first direction w1, the roller 93 may also move to the region in which the space between the outer plate 91 and the inner plate 92 has the smaller volume than the roller 93 while being rotated in the first direction w1. Here, when the outer plate 91 is rotated in the first direction w1, all of the outer plate 91, the inner plate 92, and the roller 93 can be rotated in the same direction.

In contrast, even when the outer plate 91 is rotated, the roller 93 can prevent the rotating force of the outer plate 91 from being transmitted to the inner plate 92. To be specific, when the roller 93 moves in the recess of the inner plate 92 to a region where the space between the outer plate 91 and the inner plate 92 has a larger volume than the roller 93, the roller 93 may come into contact with any one of the outer plate 91 and the inner plate 92. In this case, the roller 93 cannot transmit the rotating force of the outer plate 91 to the inner plate 92, and thus the inner plate 92 may be kept stationary even when the outer plate 91 is rotated.

According to an example, when the outer plate 91 is rotated in the second direction w2, the roller 93 may move to the region in which the space between the outer plate 91 and the inner plate 92 has the larger volume than the roller 93. Here, even when the outer plate 91 is rotated in the second direction w2, the inner plate 92 may be kept stationary.

In contrast, when the outer plate 91 is rotated in the first direction w1, the inner plate 92 is kept stationary. When the outer plate 91 is rotated in the second direction w2, all of the outer plate 91, the inner plate 92, and the roller 93 may be provided to be rotated in the second direction w2.

The plunger 94 may be installed on one side of the recess of the outer surface of the inner plate 92. The plunger 94 may be located at the region in which the space between the outer plate 91 and the inner plate 92 has the larger volume than the roller 93. The plunger 94 allows the roller 93 to be provided at a constant position between the outer plate 91 and the inner plate 92. A spring 95 may be installed at the rear of the plunger 94. The plunger 94 is connected to the spring 95 so as to allow the roller 93 to maintain a constant distance from the one side of the recess in which the plunger 94 is installed.

Hereinafter, a process of the clutch unit selectively transmit the rotating force of the outer shaft to the inner shaft depending on the rotating direction of the outer shaft will be described.

Figure 4:
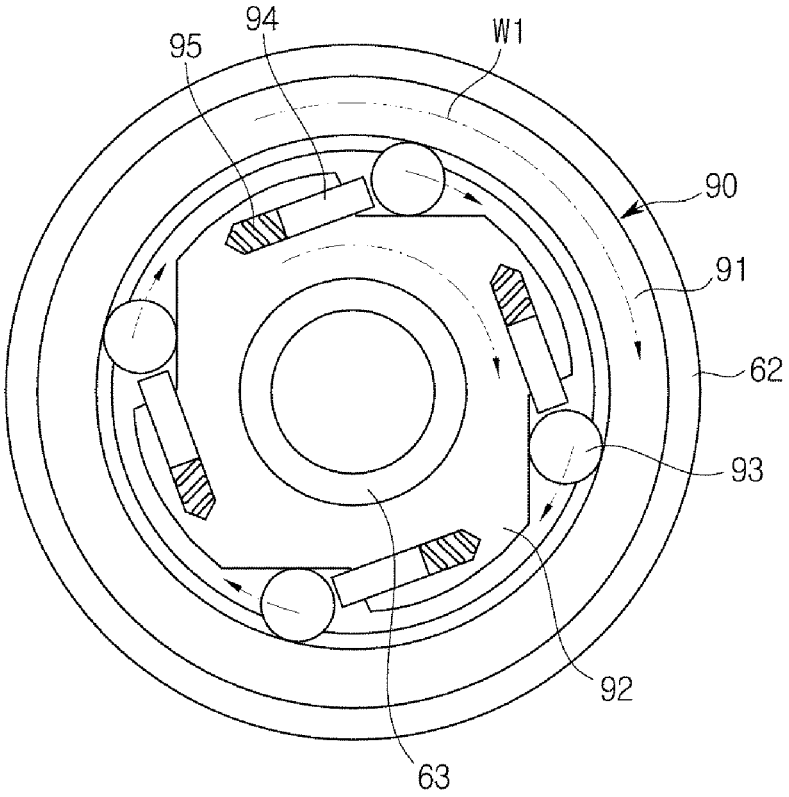
FIGS. 4 and 5 are views illustrating an operation of the clutch unit of FIG. 3.
Figure 5:
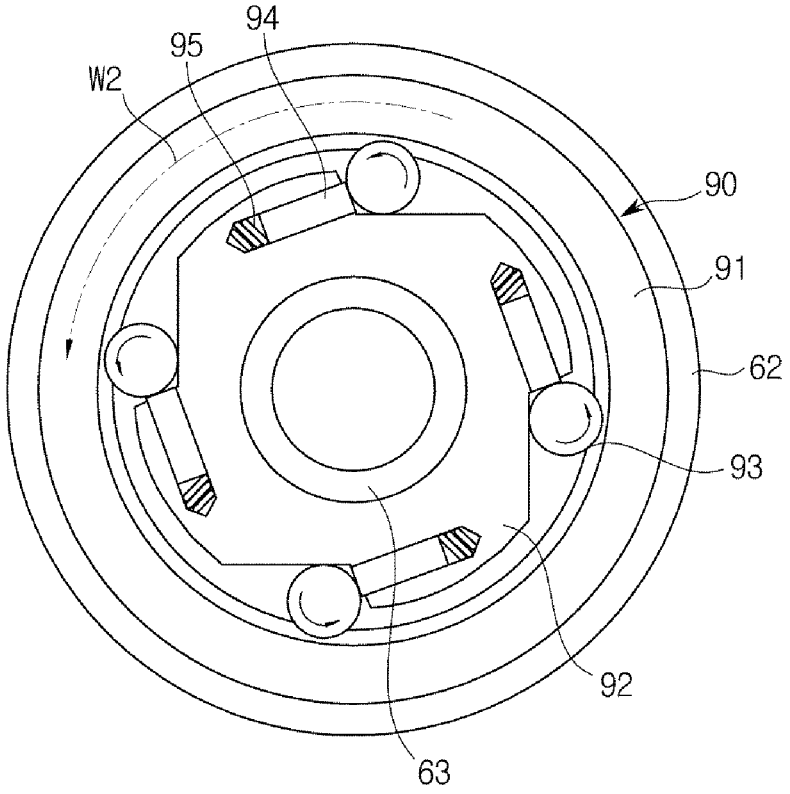

FIGS. 4 and 5 are views illustrating an operation of the clutch unit of FIG. 3.

The clutch unit according to the first embodiment of the present invention may selectively transmit the rotating force of the outer shaft to the inner shaft depending on the rotating direction of the outer shaft.

Referring to FIG. 4, when the drive unit 50 is rotated in the first direction w1, the outer shaft 62 connected to the drive unit 50 is rotated in the first direction w1. Here, the outer plate 91 of the one-way bearing press-fitted into the outer shaft 62 is also rotated in the first direction w1.

When the outer plate 91 is rotated in the first direction w1, the rollers 93 are rotated in the first direction w1 along with the outer plate 91. The rollers 93 may move rightward in the recesses of the outer surface of the inner plate 92 while being rotated in the first direction w1. The rollers 93 may each move to the regions in which the space between the outer plate 91 and the inner plate 92 has the smaller volume than the rollers 93 while being rotated in the first direction w1. The rollers 93 may be provided in contact with both the outer plate 91 and the inner plate 92. In this case, the rollers 93 can transmit the rotating force of the outer plate 91 to the inner plate 92.

The inner plate 92 may be supplied with the rotating force of the outer plate 91, and be rotated in the first direction w1 together with the outer plate 91 and the rollers 93. The inner plate 92 may be rotated in the first direction w1 together with the inner shaft 63 press-fitted into the hollow thereof. The inner shaft 63 provides the supplied rotating force to the pulsator 35 so as to be able to rotate the pulsator 35 in the first direction w1. Therefore, when the drive unit 50 is rotated in the first direction w1, the drum 30 connected to the outer shaft 62 and the pulsator 35 connected to the inner shaft 63 may be rotated together in the first direction w1.

Referring to FIG. 5, when the drive unit 50 is rotated in the second direction w2, the outer shaft 62 connected to the drive unit 50 is rotated in the second direction w2. Here, the outer plate 91 of the one-way bearing press-fitted into the outer shaft 62 is also rotated in the second direction w2.

When the outer plate 91 is rotated in the second direction w2, the rollers 93 are rotated in the second direction w2 together with the outer plate 91. The rollers 93 may move leftward in the recesses of the outer surface of the inner plate 92 while being rotated in the second direction w2. The rollers 93 may each move to the regions in which the space between the outer plate 91 and the inner plate 92 has the larger volume than the rollers 93 while being rotated in the second direction w2. Here, the rollers 93 may be provided without being restrained by the outer plate 91 and the inner plate 92. In this case, the rollers 93 cannot transmit the rotating force of the outer plate 91 to the inner plate 92.

Therefore, when the drive unit 50 is rotated in the second direction w2, the drum 30 connected to the outer shaft 62 may be rotated in the second direction w2. However, since the inner shaft 63 does not receive the rotating force from the outer shaft 62, the inner shaft 63 may be kept stationary. Thus, when the drive unit 50 is rotated in the second direction w2, only the drum 30 may be rotated in the second direction w2, and the pulsator 35 may be kept stationary.

The example in which the one-way bearing 90 transmits the rotating force of the outer shaft 62 to the inner shaft 63 when the drive unit 50 is rotated in the first direction w1, and the one-way bearing 90 does not transmit the rotating force of the outer shaft 62 to the inner shaft 63 when the drive unit 50 is rotated in the second direction w2 has been described. In contrast, the washing machine 1 may be configured such that the one-way bearing 90 does not transmit the rotating force of the outer shaft 62 to the inner shaft 63 when the drive unit 50 is rotated in the first direction w1, and the one-way bearing 90 transmits the rotating force of the outer shaft 62 to the inner shaft 63 when the drive unit 50 is rotated in the second direction w2.

As described above, the washing machine 1 according to the first embodiment of the present invention can selectively transmit the rotating force to the drum 30 and the pulsator 35 with the simple configuration including the one-way bearing 90.

During the washing, the washing machine 1 allows the drive unit 50 to change the rotating direction to the first direction w1 or the second direction w2. When the drive unit 50 is rotated in the first direction w1, the drum 30 and the pulsator 35 may be rotated together in the first direction w1. Further, when the drive unit 50 is rotated in the second direction w2, only the drum 30 may be rotated in the second direction w2. In this way, during the washing, the washing machine 1 may change the rotating direction of the drive unit 50 such that the drum 30 and the pulsator 35 are rotated together in the same direction, or the drum 30 is rotated relative to the pulsator 35. Thus, the washing machine 1 may generate the stream of water for the internal wash water. The generated stream of water agitates the laundry and the wash water in the drum 30, and thus the washing proceeds.

During the water extracting of the washing machine 1, the drive unit 50 is rotated in the first direction w1. Thus, the drum 30 and the pulsator 35 can extract water from the laundry while being rotated together in the first direction w1.

The aforementioned clutch unit 60 can selectively transmit the rotating force to the drum 30 and the pulsator 35 with the simple configuration including the one-way bearing 90. Thereby, the washing machine 1 according to a first embodiment of the present invention can be reduced in components used in the clutch unit 60, and the resulting material cost can be reduced. As the volume of the clutch unit 60 is reduced, a space which a lower portion of the washing machine 1 occupies can be reduced. Thus, the washing machine 1 enables efficient use of space.

Hereinafter, a washing machine according to a second embodiment of the present invention will be described.

A configuration overlapping that of the aforementioned embodiment will be omitted.

Figure 6:
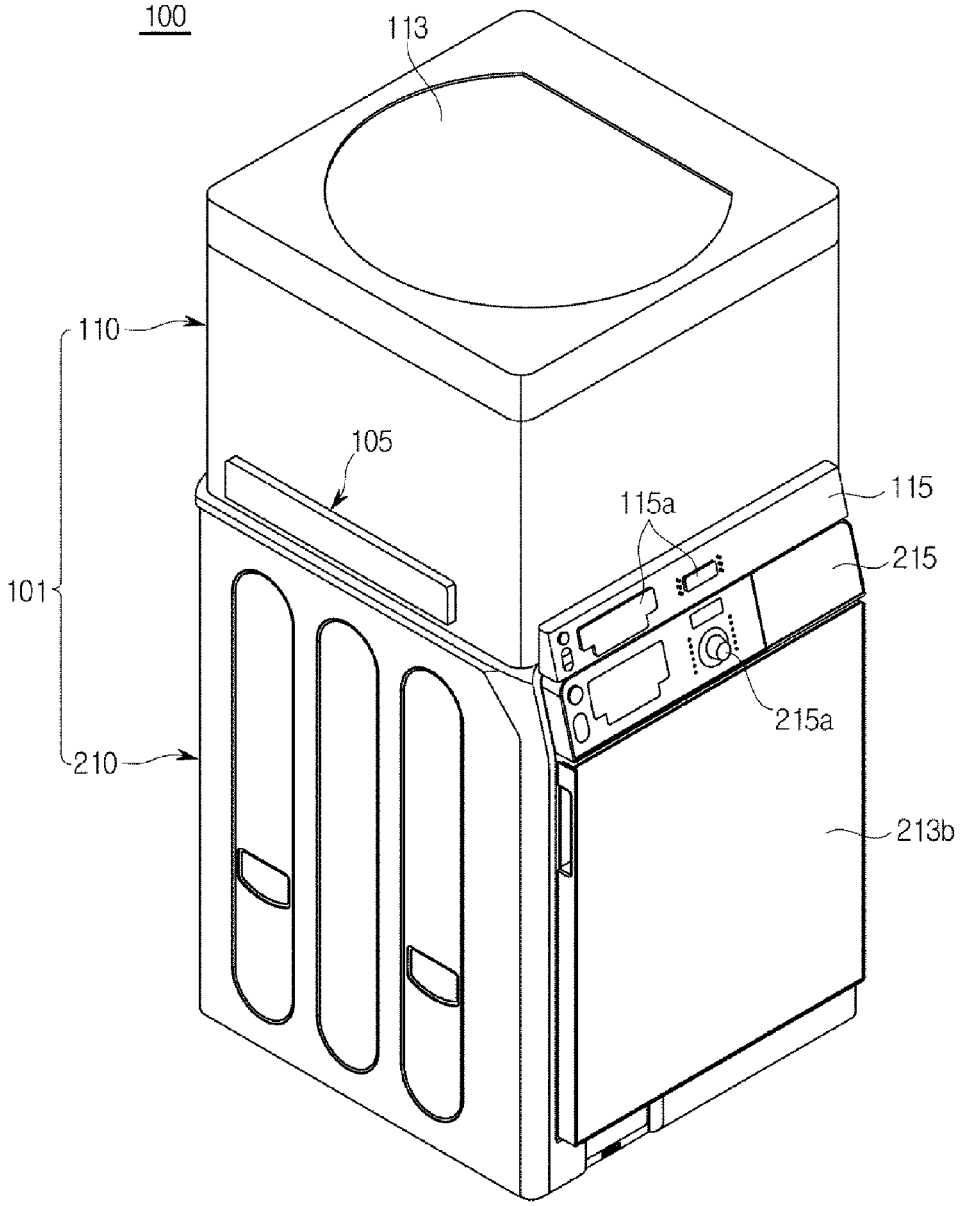
FIG. 6 is a perspective view of a washing machine according to a second embodiment of the present invention.
Figure 7:
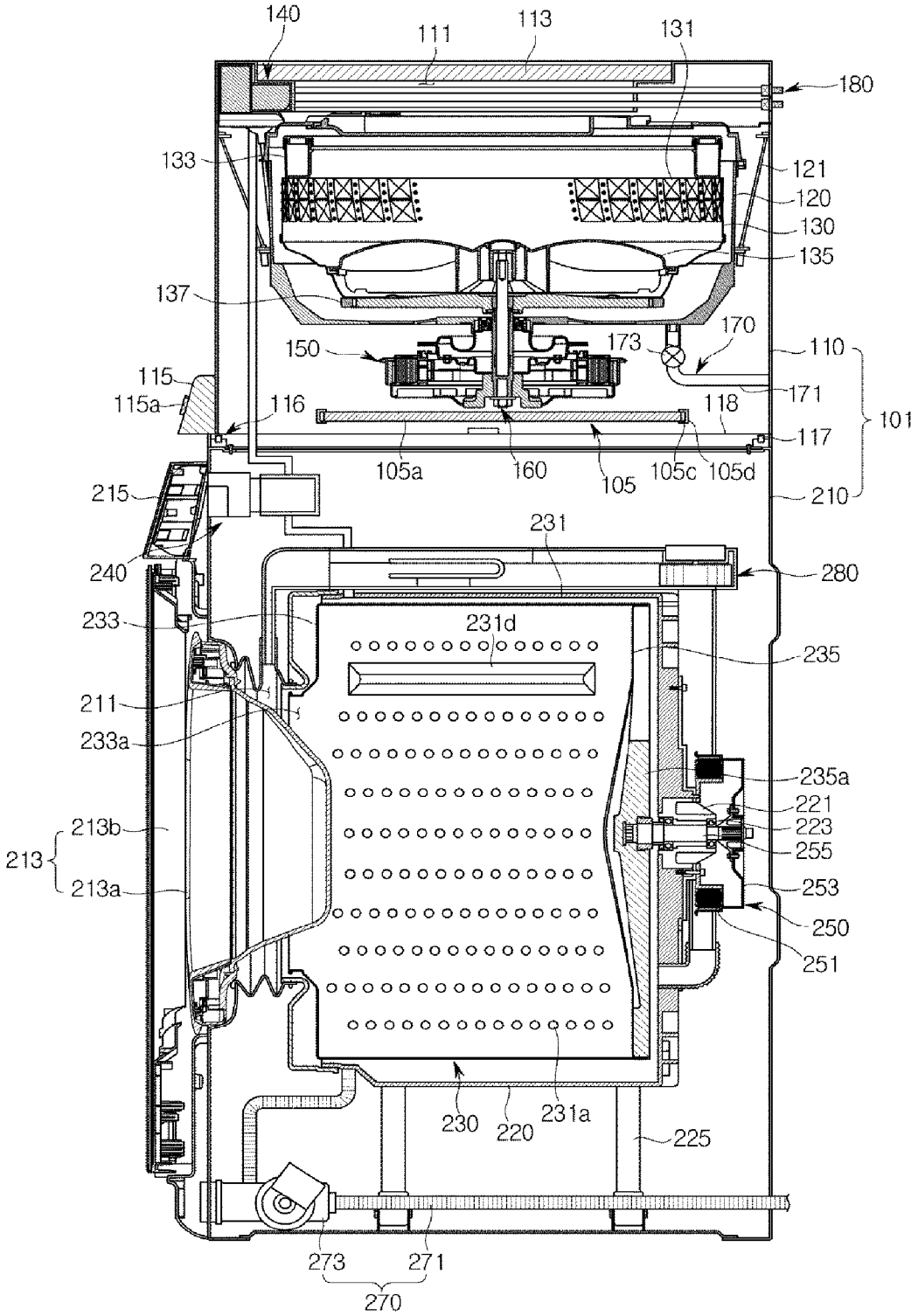
FIG. 7 is a cross-sectional view illustrating a washing machine according to a second embodiment of the present invention.

FIG. 6 is a perspective view of a washing machine according to a second embodiment of the present invention. FIG. 7 is a cross-sectional view of the washing machine according to the second embodiment of the present invention.

The washing machine 100 includes a main body 101 that forms an exterior and includes an upper cabinet 110 and a lower cabinet 210, a first tub 120 that is provided inside the upper cabinet 110 such that wash water is stored, a first drum 130 that is rotatably installed in the first tub 120, a second tub 220 that is provided inside the lower cabinet 210 such that wash water is stored, and a second drum 230 that is rotatably installed in the second tub 220.

The main body 101 includes an upper cabinet 110 and a lower cabinet 210. The upper cabinet 110 is provided with a first tub 120 and a first drum 130, and the lower cabinet 10 is provided with a second tub 220 and a second drum 230. For the convenience of description, a cabinet located at an upper portion of the main body is defined as the upper cabinet 110, and a cabinet located at a lower portion of the upper cabinet 110 is defined as the lower cabinet 210. However, the upper cabinet 110 and the lower cabinet 210 may be called a first cabinet and a second cabinet, respectively.

Since the upper cabinet 110 is provided to have a smaller volume than the lower cabinet 210, the first tub 120 and the first drum 130 provided for the upper cabinet 110 have a smaller volume than the second tub 220 and the second drum 230 provided for the lower cabinet 210.

When only one drum is provided inside the main body 101, laundry is put into the drum and is washed regardless of a quantity of the laundry. Thus, even when the quantity of the laundry is small, the drum having a large volume should be driven, which leads to the waste of power. However, the first drum 130 and the second drum 230 used to wash the laundry are provided for the upper cabinet 110 and the lower cabinet 210 in the main body 101. Thus, in the case of much laundry, the laundry may be put into and washed in the second drum 230 provided for the lower cabinet 210 having a large volume. In the case of less laundry, the laundry may be put into and washed in the first drum 130 provided for the upper cabinet 110 having a small volume.

Therefore, the washing can proceed according a quantity of laundry, and unnecessary waste of power can be prevented.

An upper portion of the upper cabinet 110 is provided with a first opening 111 such that the laundry can be put into the first drum 130. The first opening 111 may be opened/closed by a first door 113. In the embodiment of the present invention, the first door 113 may include a first inner door 113*a* and a first outer door 113*b*, both of which open/close the first opening 111.

A control panel 115 having operating buttons 115*a* so as to enable a user to control the operations of the washing machine 100 may be disposed at a front lower portion of the upper cabinet 110. The control panel 115 is provided with a user input section for operating the washing machine in addition to the operating buttons 115*a*. The control panel 115 may be provided at a lower end of the upper cabinet 110.

The first tub 120 may be provided such that wash water is stored therein, and may be disposed in the upper cabinet 110 so as to be supported by dampers 121.

The first drum 130 is formed in an approximately cylindrical shape whose interior is empty, and is rotatably disposed in the first tub 120.

The sidewall of the first drum 130 may be provided with numerous through-holes 131 such that the wash water flows between the interior and exterior of the first drum 130. A balancer 133 may be provided at an upper portion of the first drum 130.

A pulsator 135 is rotatably installed on the bottom of the first drum 130. The pulsator 135 serves to agitate the laundry put into the first drum 130 together with the wash water.

A flanged shaft 137 is coupled to a lower portion of the first drum 130. The flanged shaft 137 is connected to a rotating shaft 161 to be described below such that the first drum 130 is rotated by a drive unit 150.

An inner upper portion of the upper cabinet 110 is provided with an automatic detergent supply unit 140 that automatically supplies liquid detergent and fabric softener into the first tub 120 and the second tub 220. The liquid detergent and the fabric softener in the automatic detergent supply unit 140 are supplied into the first tub 120 and the second tub 220 via the automatic detergent supply unit 140 by a feed unit 180 connected to the first tub 120 and the second tub 220 together with the wash water.

The drive unit 150 is disposed below the first tub 120. The drive unit 150 is supplied with power, and generates a driving force. The drive unit 150 may generate the driving force in the first direction w1 and the second direction w2. According to an example, the drive unit 150 may include a motor. The drive unit 150 is connected to a clutch unit 160.

The drive unit 150 and the clutch unit 160 will be described below in detail.

A drain unit 170 is provided to be connected to a lower portion of the first tub 120 in order to drain away the wash water after a washing process or a water extracting process is completed from the upper cabinet 110. The drain unit 170 may include a first drain pipe 171 that guides the wash water in the first tub 120 to be drained away, a drain valve 173 that is disposed on the first drain pipe 171 and opens/closes the first drain pipe 171, and a drain pump (not shown) that is disposed on the first drain pipe 171 and causes the wash water used for the washing to be drained through the first drain pipe 171.

The wash water is fed from an external water supply source (not shown) to the feed unit 180 via the automatic detergent supply unit 140, and then the feed unit 180 feeds the wash water to the first tub 120 and the second tub 220.

The feed unit 180 is provided for the upper cabinet 11 so as to connect the external water supply source and the automatic detergent supply unit 140, and feeds the wash water to the second tub 220 and the first tub 120 via the automatic detergent supply unit 140 together with the liquid detergent and the fabric softener of the automatic detergent supply unit 140.

A second opening 211 is provided at a front central side of the lower cabinet 210 so as to be able to put the laundry into the second drum 230. The second opening 211 is opened/closed by a second door 213 that is rotatably installed in the front of the lower cabinet 210. In the embodiment of the present invention, the second door 213 may include a second inner door 213*a* and a second outer door 213*b*, both of which open/close the second opening 211.

A control panel 215 having operating buttons 215*a* so as to enable a user to control the operations of the washing machine 100 is disposed at a front upper portion of the lower cabinet 210. A circuit board (not shown) on which a controller (not shown) transmitting the operations caused by the operating buttons 215*a* is mounted may be disposed inside the control panel 215.

In the present embodiment, the control panel 115 of the upper cabinet 110 and the control panel 125 of the lower cabinet 210 are separately configured. However, the control panels 115 are 215 may be formed into one control panel so as to be able to control both the operations at the upper cabinet 110 and the operations at the lower cabinet 210.

The second tub 220 stores the wash water to be used for the washing, and is supported by dampers 225. The dampers 225 connect an inner bottom of the lower cabinet 210 and an outer surface of the second tub 220.

A bearing housing 221 that rotatably supports a rotating shaft 2 connected to a drive motor 250 to be described below is formed on a rear wall of the second tub 220 by insert injection. Bearings 223 rotatably supporting the rotating shaft 255 are installed in the bearing housing 221.

The second drum 230 includes a cylindrical body 231, a front plate 233 disposed in the front of the body 231, and a rear plate 235 disposed in the rear of the body 231.

The body 231 may be provided with numerous through-holes 231*a* through which the wash water flows, and a plurality of lifters 231*b* that are disposed on an inner circumferential surface thereof at intervals in a circumferential direction so as to lift the laundry upward.

The front plate 233 is formed with an opening 233*a* through which the laundry comes in or out. A shaft flange 235*a* to which the rotating shaft 255 of the drive motor 250 to be described below is connected may be installed on the rear plate 235.

An inner upper portion of the lower cabinet 210 is provided with a detergent box 240 from which a powder detergent and a bleaching agent are supplied into the second tub 220. The powder detergent and the bleaching agent in the detergent box 240 are supplied into the second tub 220 by the feed unit 180 connected to the second tub 220 via the detergent box 240 together with the wash water.

The drive motor 250 includes a stator 251 that is fixed to the rear of the second tub 220, a rotor 253 that is rotated by interaction with the stator 251, and the rotating shaft 255, one end of which is fixed to the center of the rotor 253, and the other end of which passes through the second tub 220 and is fixed to the center of the rear plate 235 of the second drum 230.

The rotating shaft 255 is rotated by the rotor 253 rotated due to the interaction with the stator 251, and the drum 230 connected to the rotating shaft 255 is rotated by the rotation of the rotating shaft 255 to perform the washing.

A drain unit 270 for draining away the wash water used for the washing from the main body 101 is disposed below the second tub 220.

The drain unit 270 includes a second drain pipe 271 that guides the wash water of the second tub 220 to be drained away from the main body 101, and a drain pump 273 that is disposed on the second drain pipe 271 such that the wash water used for the washing is drained through the second drain pipe 271.

The first drain pipe 171 of the drain unit 170 for draining away the wash water from the upper cabinet 110 and the second drain pipe 271 of the drain unit 270 for draining away the wash water from the lower cabinet 210 may be interconnected to drain away the wash water from the main body 101. Alternatively, the wash water may be drained away from the main body 101 without interconnecting the first drain pipe 171 and the second drain pipe 271.

The second tub 220 may be mounted with a drying unit 280 that dries air in the second tub 220 and then supplies it into the second tub 220 again.

Figure 8:
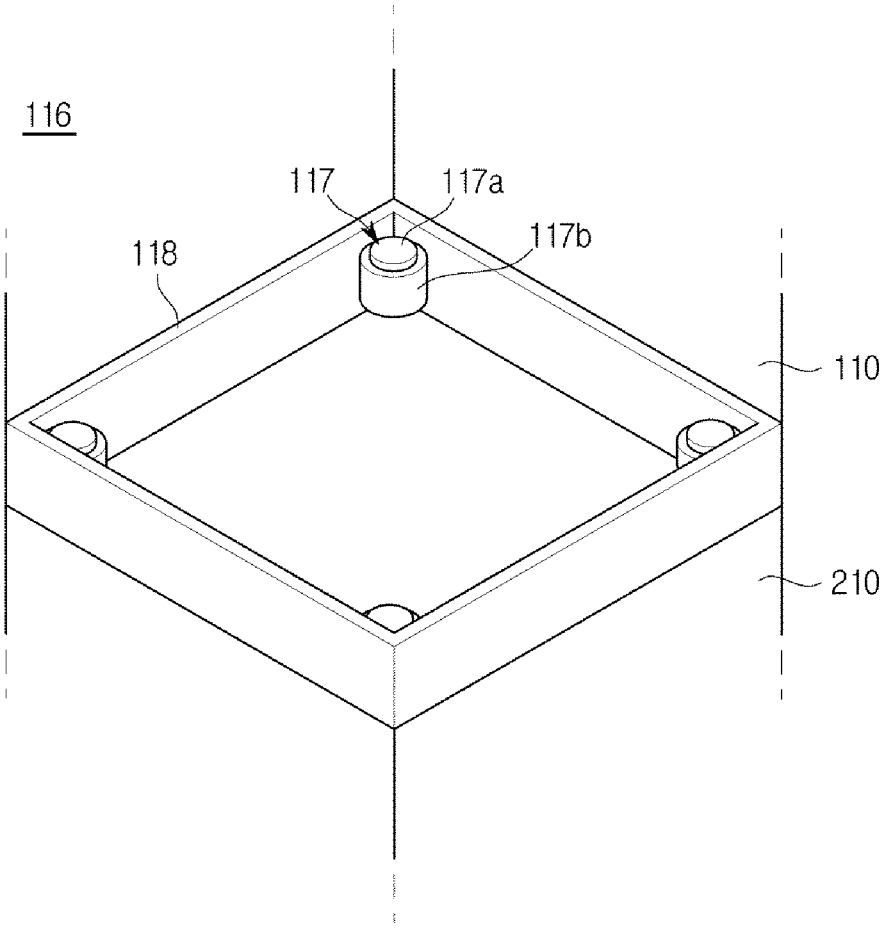
FIG. 8 is a view illustrating a vibration reduction unit in the washing machine according to the second embodiment of the present invention.

FIG. 8 is a schematic view illustrating a vibration reduction unit in the washing machine according to the second embodiment of the present invention.

The washing machine may include a vibration reduction unit 116 provided between the upper cabinet 110 and the lower cabinet 210 in order to reduce vibration between the upper cabinet 110 and the lower cabinet 210.

The vibration reduction unit 116 may be provided at a lower portion of the upper cabinet 110. An upper portion of the vibration reduction unit 116 may be provided to support the lower portion of the upper cabinet 110, and a lower portion of the vibration reduction unit 116 may be provided to support an upper portion of the lower cabinet 210.

The vibration reduction unit 116 may include an elastic unit 117 and a guide panel 118.

The elastic unit 117 includes a support part 117*a* that is connected to the lower portion of the upper cabinet 110, and an elastic part 117*b* that is provided at a lower portion of the support part 117*a* and elastically supports the support part 117*a* with respect to an upper surface of the lower cabinet 210.

The support part 117*a* may be provided in a screw shape and be coupled to the lower portion of the upper cabinet 110. The elastic part 117*b* may be coupled to the lower portion of the support part 117*a* and be provided such that the support part 117*a* and the upper cabinet 110 are elastically supported on the upper portion of the lower cabinet 210.

The number and disposition of elastic units 117 are not limited. As an example, four elastic units 117 may be disposed at respective vertexes at the lower portion of the upper cabinet 110.

The guide panel 118 may be formed around the elastic units 117 between the upper cabinet 110 and the lower cabinet 210. A space between the upper cabinet 110 and the lower cabinet 210 may be separated due to the vibration reduction unit 116, and the guide panel 118 may be provided to enclose the separated space.

The guide panel 118 may be formed in a direction in which it extends from an outer surface of the main body 101 so as not to have a height difference with the main body 101.

With regard to the configuration of the vibration reduction unit 116, the above description is given as an example. However, without being limited thereto, any configuration may be employed as long as the vibration generated from the upper cabinet 110 is reduced and transmitted to the lower cabinet 210.

Figure 9:
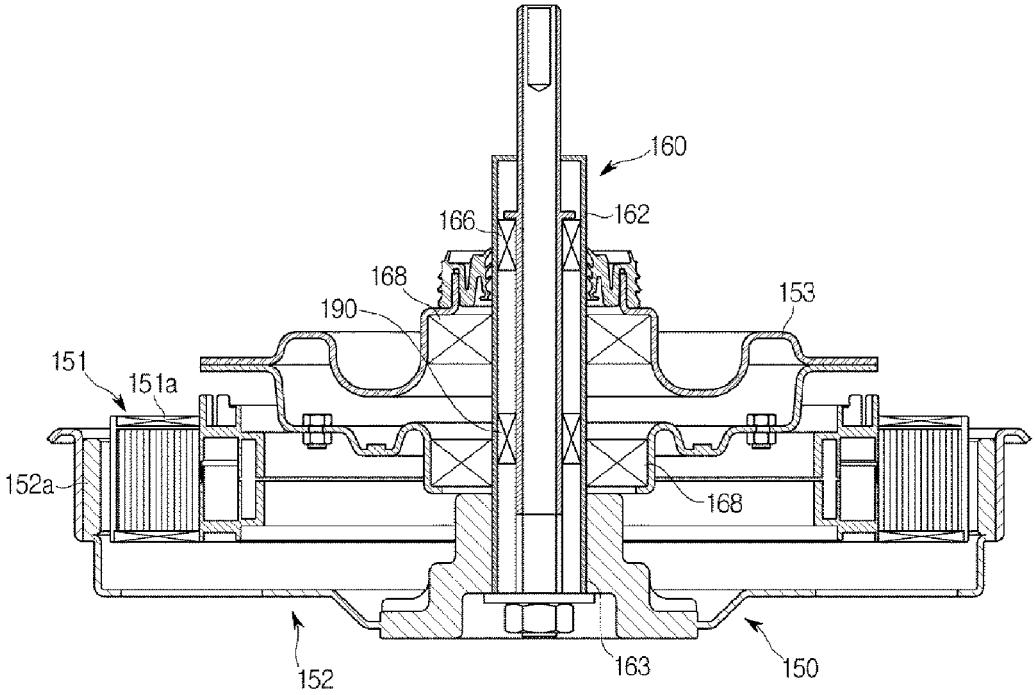
FIG. 9 is a cross-sectional view of a clutch unit in the washing machine according to the second embodiment of the present invention.

FIG. 9 is a cross-sectional view of a clutch unit according to the second embodiment of the present invention.

The drive unit 150 is provided to receive power to generate a driving force.

The drive unit 150 may include a stator 151 having a coil 151*a*, and a rotor 152 that is rotated by interaction with the stator 151 including magnets 152*a* interacting with the coil 151*a*. The stator 151 may be coupled to a stator coupler 153 that is fixedly coupled to the lower portion of the first tub 120. The stator coupler 153 is provided to correspond to the stator 151. The stator coupler 153 is provided such that one surface of the stator 151 can be coupled to a lower surface thereof.

The drive unit 150 transmits the generated driving force to the clutch unit 160. A rotating force generated from the drive unit 150 may be selectively transmitted to both or one of the drum 130 and the pulsator 135 through the clutch unit 160.

The clutch unit 160 is disposed between the drive unit 150 and the first tub 120. The clutch unit 160 may selectively transmit the rotating force of the drive unit 50 to the first tub 120 and the pulsator 135.

The clutch unit 160 may include a rotating shaft 161, bearings 166 and 168, and a one-way bearing 190. The rotating shaft 161 may include an outer shaft 162 and an inner shaft 163.

According to the embodiment of the present invention, the outer shaft 162 connects the first drum 130 and the drive unit 150. One side of the outer shaft 162 may be connected to the first drum 130, and the other side of the outer shaft 162 may be connected to the drive unit 150. Thereby, the outer shaft 162 may directly transmit the rotating force generated from the drive unit 150 to the first drum 130.

The outer shaft 162 may be formed as a cylindrical shaft whose interior is hollow. The inner shaft 63, the bearings 166 and 168, and the one-way bearing 190 may be located in the hollow of the outer shaft 162.

The inner shaft 163 is located in the hollow of the outer shaft 162. The inner shaft 163 may be formed as a cylindrical shaft whose interior is hollow. The inner shaft 163 may be provided in such a way that an upper end thereof protrudes upward relative to an upper end of the outer shaft 162. One side of the inner shaft 163 may be connected to the pulsator 135. The inner shaft 163 may transmit the rotating force of the drive unit 150 to the pulsator 135.

The bearing 166 may be installed between the inner shaft 163 and the outer shaft 162. The bearing 166 may support the inner shaft 163 and the outer shaft 162. Further, the bearing 166 may be provided to allow the inner shaft 163 and the outer shaft 162 to be separately rotated. The bearing 168 may be provided on a circumference of the outer shaft 162. The bearing 168 provided on the circumference of the outer shaft 162 is provided to rotatably support the outer shaft 162. Further, a pair of bearings 168 may be provided to rotatably support the outer shaft 162. In detail, the pair of bearings 168 may be provided in the stator coupler 153 so as to rotatably support the outer shaft 162. According to an example, the bearings 166 and 168 may be provided as oilless bearings.

The one-way bearing 190 may be installed between the inner shaft 163 and the outer shaft 162. The inner shaft 163 may be supplied with the rotating force of the drive unit 150 from the one-way bearing 190. The one-way bearing 190 may selectively transmit a rotating force of the outer shaft 162 to the inner shaft 163.

Operations of the outer shaft 162, the inner shaft 163, and the one-way bearing 190 are the same as in the first embodiment and has been described reference to FIGS. 3 to 5.

In a washing mode, the washing machine 100 allows the drive unit 150 to change the rotating direction into the first direction w1 or the second direction w2. When the drive unit 150 is rotated in the first direction w1, the drum 130 and the pulsator 135 may be rotated together in the first direction w1. Further, when the drive unit 150 is rotated in the second direction w2, only the drum 130 may be rotated in the second direction w2. In this way, during the washing, the washing machine 100 may change the rotating direction of the drive unit 150 such that the drum 130 and the pulsator 135 are rotated together in the same direction, or the drum 130 is rotated relative to the pulsator 135. Thus, the washing machine 100 may generate the stream of water for the internal wash water. The generated stream of water agitates the laundry and the wash water in the drum 130 to perform the washing.

During the water extracting of the washing machine 100, the drive unit 150 is rotated in the first direction w1. Thus, the drum 130 and the pulsator 135 can extract water from the laundry while being rotated together in the first direction w1.

The aforementioned clutch unit 160 can selectively transmit the rotating force to the drum 130 and the pulsator 135 with the simple configuration including the one-way bearing 190. Thereby, the number of components used in the clutch unit 160 of the washing machine 100 according to the embodiment of the present invention can be reduced, and the resulting material cost can be reduced. As the volume of the clutch unit 160 is reduced, a space which a lower portion of the washing machine 100 occupies can be reduced. Thus, the washing machine 100 enables efficient use of space.

Figure 10:
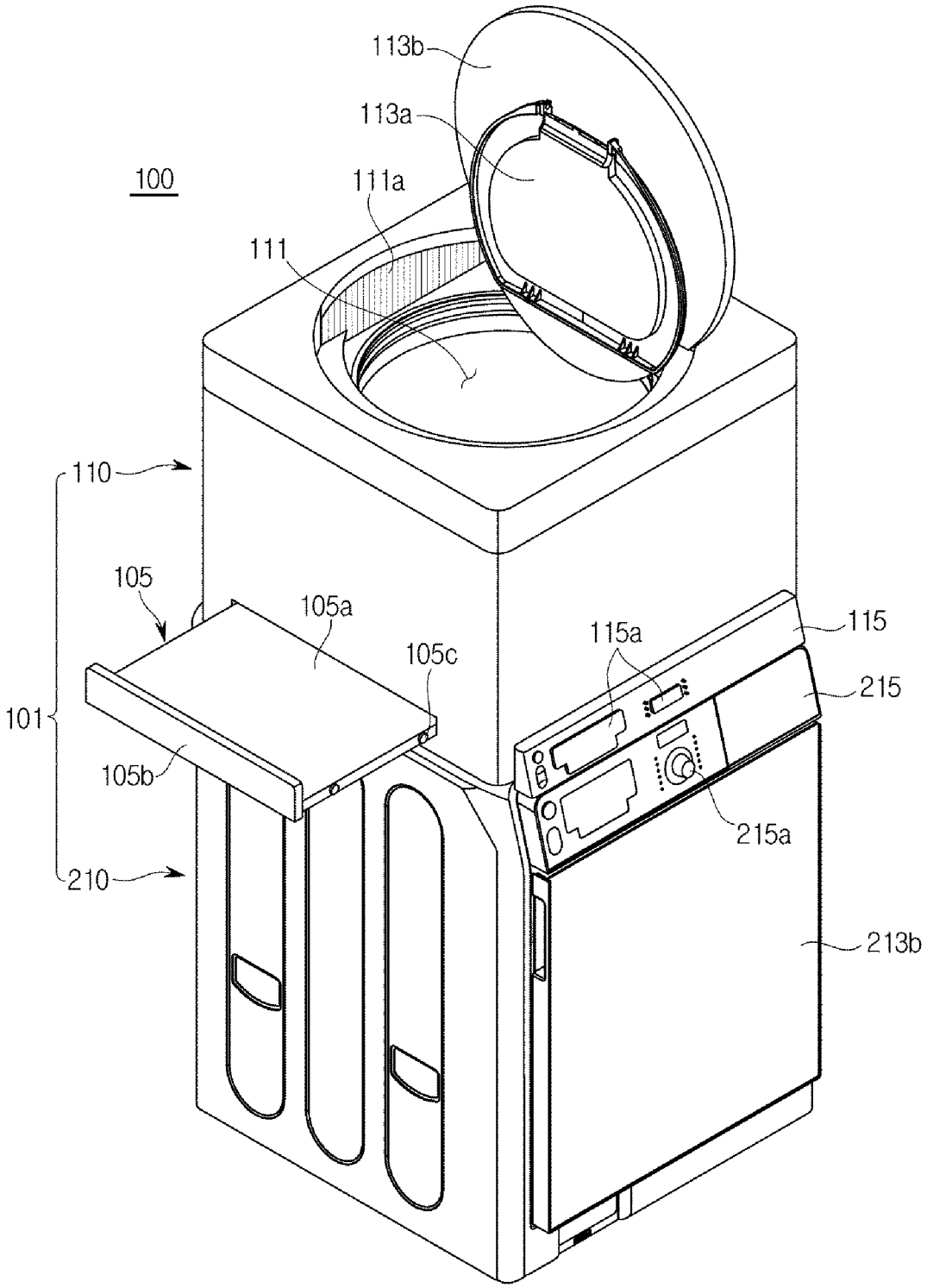
FIG. 10 is a perspective view of the washing machine according to the second embodiment of the present invention.

FIG. 10 is a perspective view of the washing machine according to the second embodiment of the present invention.

The upper cabinet 110 of the washing machine 100 may include a reflector 111*a* through which the laundry in the upper cabinet 110 can be seen from the outside.

Since the upper cabinet 110 is located higher than the lower cabinet, a user may have difficulty seeing the interior of the upper cabinet 110 to withdraw the laundry. For this reason, the reflector 111*a* is provided for the first opening 111 of the upper cabinet 110 so as to enable the user to easily see the interior of the first drum 130 from the outside.

In the embodiment of the present invention, when the control panels 115 and 215 are disposed in the front of the washing machine 100 in order to operate the washing machine 100, the first door 113 opening/closing the first opening 111 may be provided to pivot in a leftward/rightward direction. The reflector 111*a* is disposed in the rear of the first opening 111 so as to enable the user to stand in front of the control panels 115 and 215 to see the interior of the first drum 130 through the reflector 111*a*.

The washing machine 100 may include a laundry tray 105 for placing the laundry.

The laundry tray 105 is provided for the cabinet such that the laundry can be placed thereon. The laundry tray 105 may be provided to be able to be pulled out of/into the cabinet.

The disposition of the laundry tray 105 is not limited. In the embodiment of the present invention, the laundry tray 105 may be disposed inside the upper cabinet 110 so as to be able to be pulled out of the upper cabinet 110.

The laundry tray 105 includes a tray body 105*a* on which the laundry is placed, a handle 105*b* extending from the tray body 105*a* that can be grasped, sliding rollers 105*c* provided at opposite sides of the tray body 105*a*, and sliding rails 105*d* guiding motions of the sliding rollers 105*c*.

The laundry tray 105 is provided to be movable between a first position at which the tray body 105*a* is inserted in the upper cabinet 110 and a second position at which the tray body 105*a* moves from the first position so as to allow the laundry to be placed on the tray body 105*a*. The movement between the first position and the second position is achieved through the sliding rollers 105*c* and rails 105*d*.

The laundry tray 105 is not limited to the aforementioned shape. For example, not only may the laundry be placed on the laundry tray 105, but the laundry tray may also be provided in the shape of a drawer forming a storage space capable of storing the laundry, or provided to form a drying chamber for drying the laundry.

Hereinafter, a washing machine according to a third embodiment of the present invention will be described.

Description of the same components as in the previous embodiments will be omitted.

Figure 11:
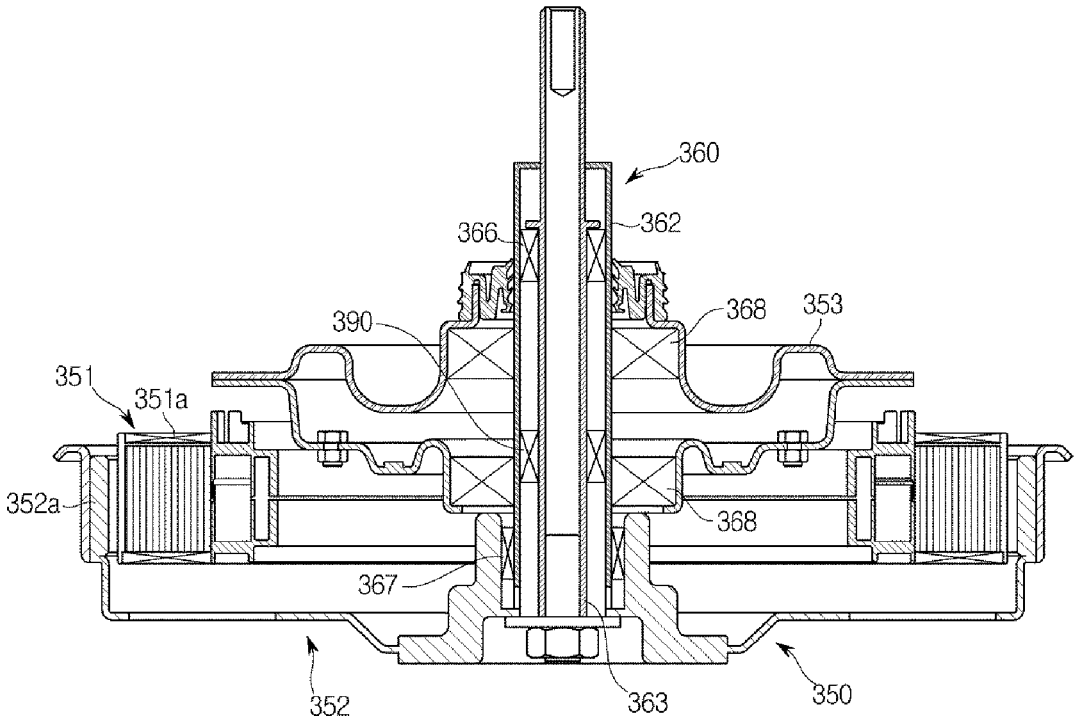
FIG. 11 is a cross-sectional view of a clutch unit in a washing machine according to a third embodiment of the present invention.

FIG. 11 is a cross-sectional view of a clutch unit according to a third embodiment of the present invention.

A clutch unit 360 may include an outer shaft 362, an inner shaft 363, bearings 366 and 368, and a one-way bearing 190.

According to the embodiment of the present invention, the inner shaft 363 connects a pulsator 335 and a drive unit 350. One side of the inner shaft 363 may be connected to the pulsator 335, and the other side of the inner shaft 363 may be connected to the drive unit 350. Thereby, the inner shaft 363 may directly transmit a rotating force generated from the drive unit 350 to the pulsator 335.

The inner shaft 363 may be formed as a cylindrical shaft. The outer shaft 362, the bearings 366 and 368, and the one-way bearing 390 may be located along a circumference of the inner shaft 363.

The inner shaft 363 is located in a hollow of the outer shaft 362. The inner shaft 363 may be formed as a cylindrical shaft. The inner shaft 363 may be provided in such a way that an upper end thereof protrudes upward relative to an upper end of the outer shaft 362. One side of the inner shaft 363 may be connected to the pulsator 335. The inner shaft 363 may transmit the rotating force of the drive unit 350 to the pulsator 335. One side of the outer shaft 362 is connected to a first drum 330.

The bearing 366 may be installed between the inner shaft 363 and the outer shaft 362. The bearing 366 may support the inner shaft 363 and the outer shaft 362. Further, the bearing 366 may be provided to allow the inner shaft 363 and the outer shaft 362 to be separately rotated. The bearing 368 may be provided on a circumference of the outer shaft 362. The bearing 368 provided on the circumference of the outer shaft 362 is provided to rotatably support the outer shaft 362. Further, a pair of bearings 368 may be provided to rotatably support the outer shaft 362. In detail, the pair of bearings 368 may be provided in a stator coupler 353 so as to rotatably support the outer shaft 362. According to an example, the bearing 366 may be provided as an oilless bearing. Further, an auxiliary bearing 367 may be provided between the outer shaft 362 and a rotor 352 for relative movement. The rotor 352 is coupled and operated with the inner shaft 363. Thus, the auxiliary bearing 367 allows the rotor 352 and the inner shaft 363 to be operated independently of each other.

The one-way bearing 190 may be installed between the inner shaft 163 and the outer shaft 162. The inner shaft 163 may be supplied with the rotating force of the drive unit 150 from the one-way bearing 190. The one-way bearing 190 may selectively transmit a rotating force of the outer shaft 162 to the inner shaft 163.

In a washing mode, the washing machine 100 allows the drive unit 350 to change the rotating direction to the first direction w1 or the second direction w2. When the drive unit 350 is rotated in the first direction w1, the drum 330 and the pulsator 335 may be rotated together in the first direction w1. Further, when the drive unit 350 is rotated in the second direction w2, only the pulsator 335 may be rotated in the second direction w2. In this way, during the washing, the washing machine 100 may change the rotating direction of the drive unit 350 such that the drum 330 and the pulsator 335 are rotated together in the same direction, or the drum 330 is rotated relative to the pulsator 335. Thus, the washing machine 100 may generate the stream of water for the internal wash water. The generated stream of water agitates the laundry and the wash water in the drum 330 to perform the washing.

During the water extracting of the washing machine 100, the drive unit 350 is rotated in the first direction w1. Thus, the drum 330 and the pulsator 335 can extract water from the laundry while being rotated together in the first direction w1.

The aforementioned clutch unit 360 can selectively transmit the rotating force to the drum 330 and the pulsator 335 with the simple configuration including the one-way bearing 390. Thereby, the number of components used in the clutch unit 360 of the washing machine 100 according to the embodiment of the present invention can be reduced, and the resulting material cost can be reduced. As the volume of the clutch unit 360 is reduced, a space which a lower portion of the washing machine 100 occupies can be reduced. Thus, the washing machine 100 enables efficient use of space.

Hereinafter, a washing machine according to a fourth embodiment of the present invention will be described.

Description of the same components as in the previous embodiments will be omitted.

Figure 12:
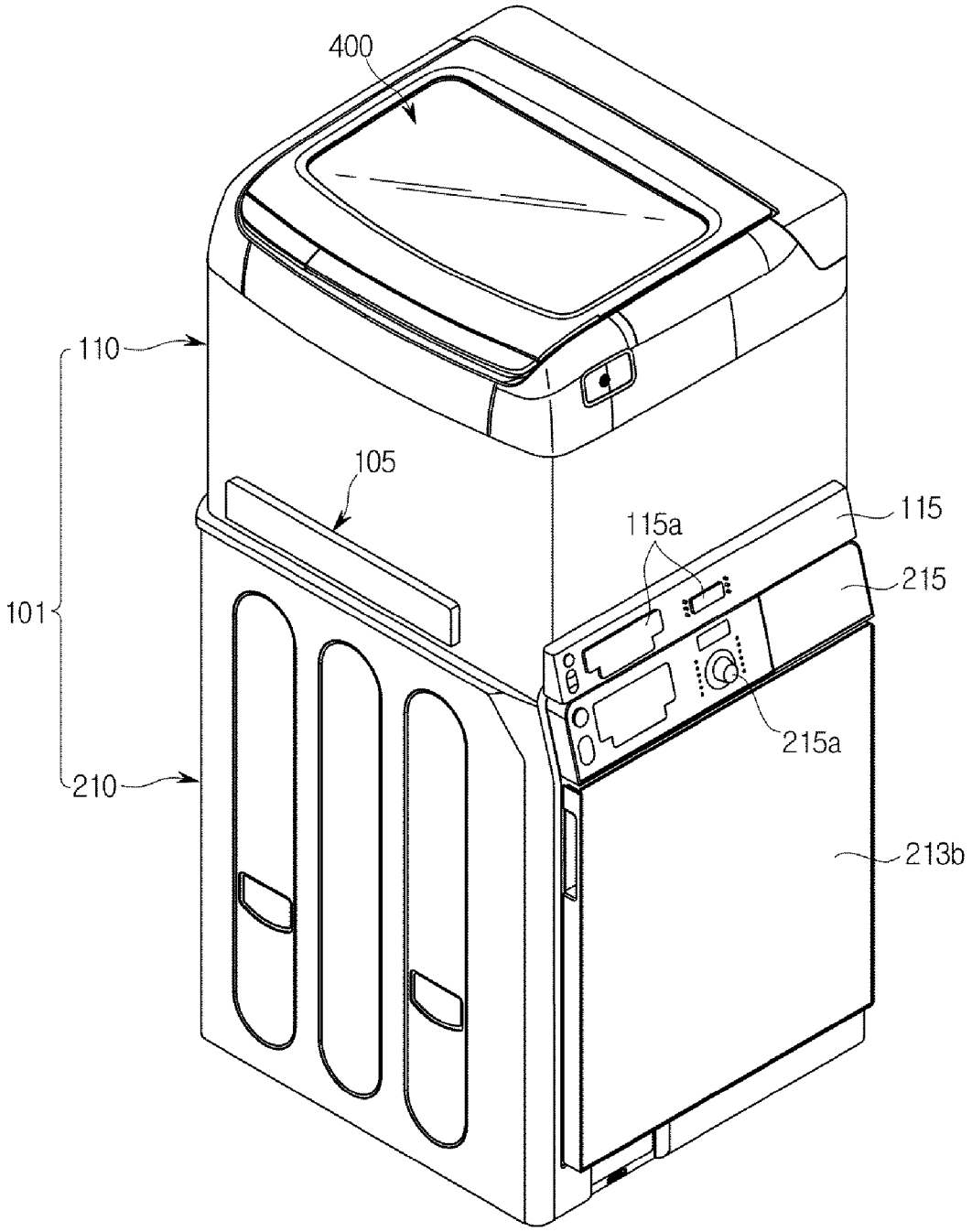
FIGS. 12 to 14 are perspective views illustrating a washing machine according to a fourth embodiment of the present invention.
Figure 13:
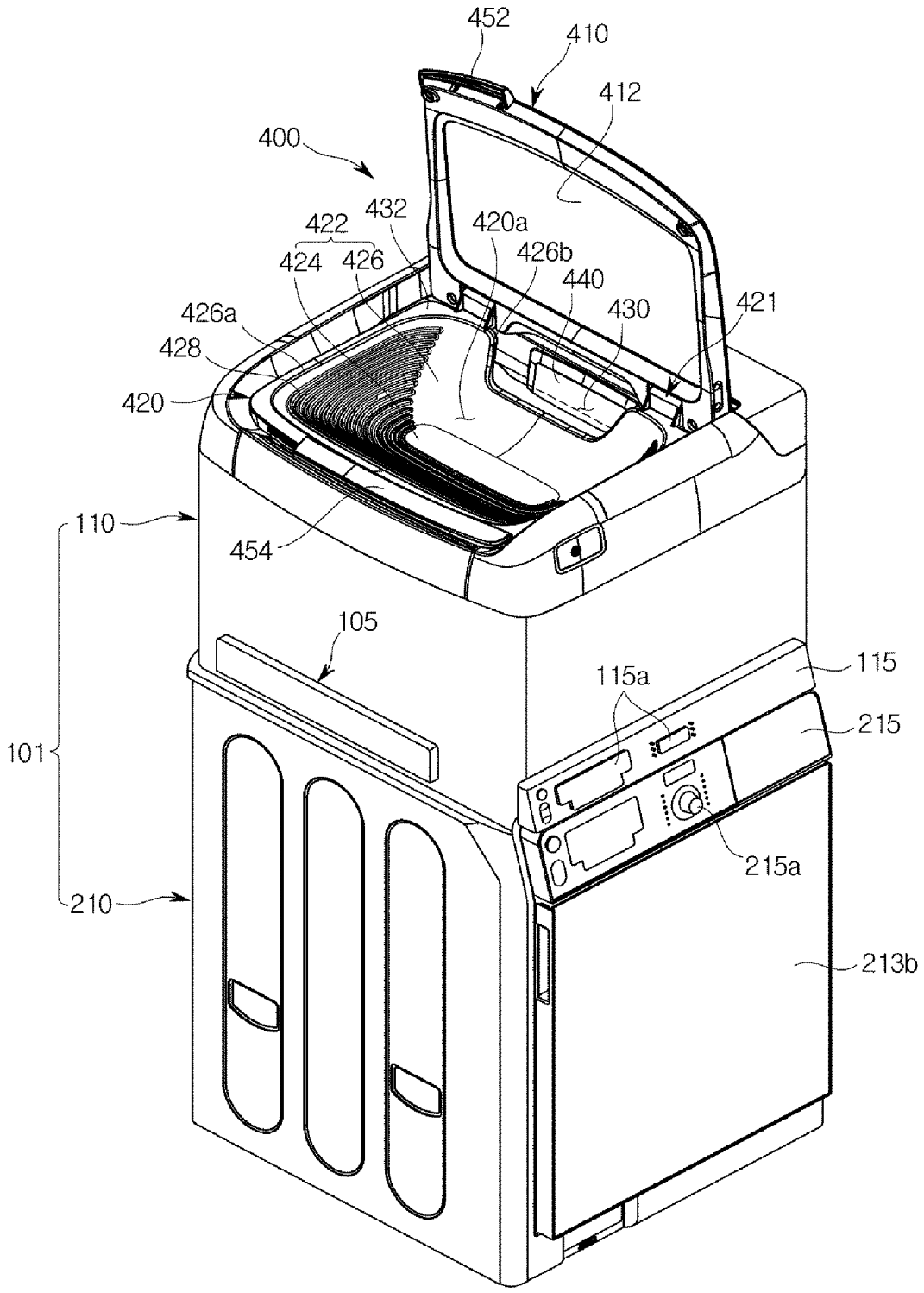
Figure 14:
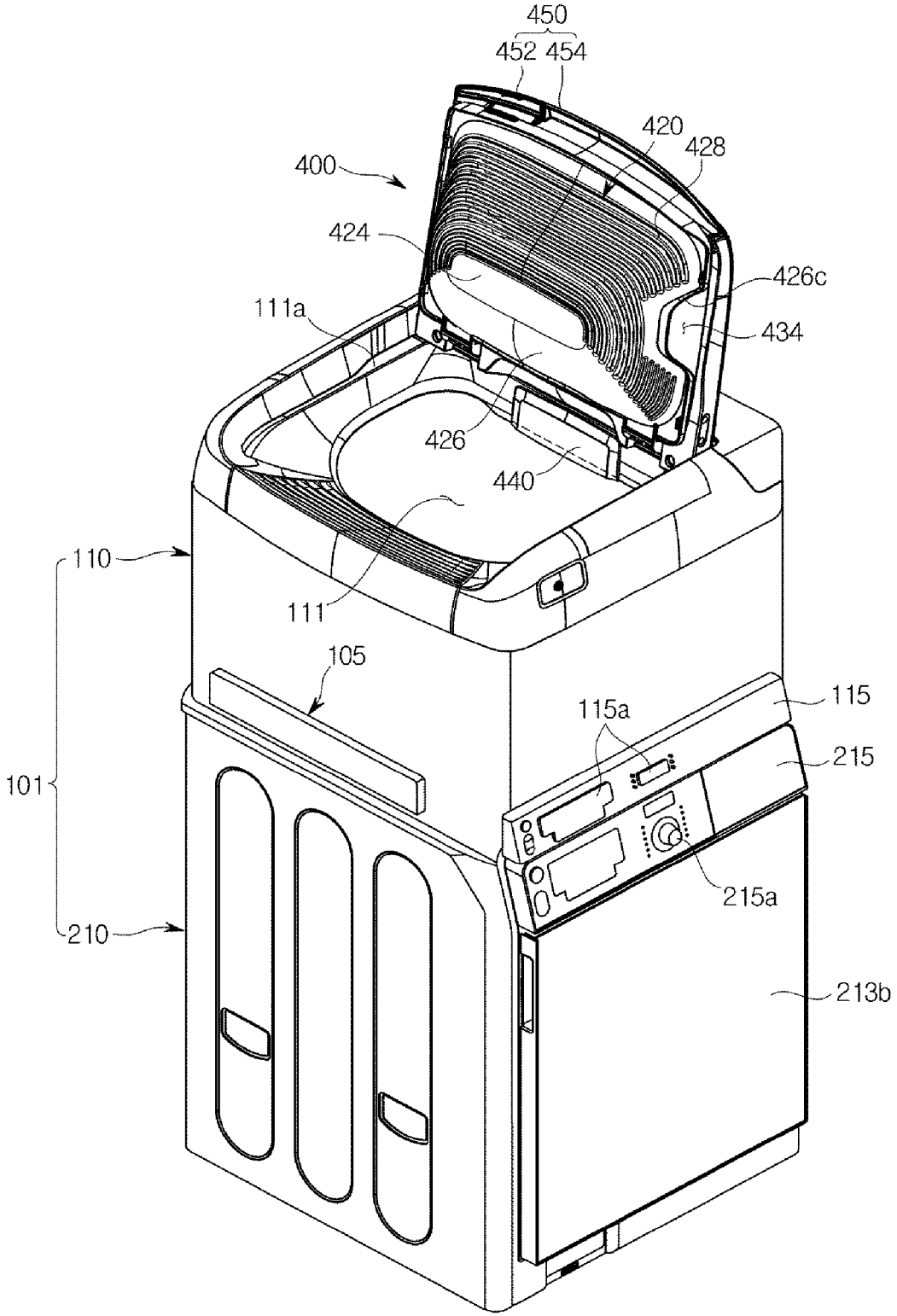

FIGS. 12 to 14 are perspective views of a washing machine according to a fourth embodiment of the present invention.

A door assembly 400 may be provided for a first opening 111 of a first cabinet 110.

The door assembly 400 may include a door 410 and an auxiliary washing unit 420.

The door 410 is provided on one side of the first cabinet 110 so as to open/close the first opening 111. The door 410 may be provided with a transparent member 412 such that an interior of the first cabinet 110 is seen with the first opening 111 closed.

The auxiliary washing unit 420 provides an auxiliary washing space 420*a* so as to allow separate washing by hand. The auxiliary washing space 420*a* is separated from a first drum 130 and a main washing space 130*a* formed by a first tub 120 so that washing can be performed. The first tub 120 forming the main washing space 130*a* and the first drum 130 can be defined as a laundering drum.

The main washing space 130*a* and the auxiliary washing space 420*a* are separated so that washing can be performed independently. Further, the washing performed in the main washing space 130*a* and the washing performed in the auxiliary washing space 420*a* may be performed separately or at the same time.

The auxiliary washing unit 420 may be provided to be rotatable about one side thereof at an inner side of the door 410. The auxiliary washing unit 420 may be provided to have the same axis as a pivotal axis of the door 410.

The auxiliary washing unit 420 may include an auxiliary pivotal part 421. The auxiliary pivotal part 421 is provided to be inserted into the door 410 so as to be pivotable about the door 410. That is, the auxiliary pivotal part 421 of the auxiliary washing unit 420 may be rotatably coupled at one side of the door 410. The example in which the auxiliary washing unit 420 is provided to be rotatable with respect to the door 410 has been described. However, the auxiliary washing unit 420 may be provided to be rotatable with respect to the first cabinet 110.

The auxiliary washing unit 420 may include a unit body 422 made up of a bottom portion 424 and a lateral portion 426.

The auxiliary washing space 420*a* of the auxiliary washing unit 420 is defined by the unit body 422. The bottom portion 424 is a factor that determines a depth of the auxiliary washing space 420*a*, and may be provided to be flat or curved. The lateral portion 426 is formed to be inclined toward the bottom portion 424.

The bottom portion 424 and the lateral portion 426 are provided such that the auxiliary washing space 420*a* is approximately recessed. As a result, the wash water is given to the auxiliary washing space 420*a* so that separate washing can be performed.

The auxiliary washing unit 420 may include rubbing ridges 428.

The rubbing ridges 428 are provided for the unit body 422 so as to facilitate auxiliary washing. In the embodiment of the present invention, the rubbing ridges 428 are configured to be provided for the lateral portion 426. However, the present invention is not limited to such a configuration. The rubbing ridges 428 may be configured to be provided for an inner surface of the unit body 422. During the washing by hand, the rubbing ridges 428 increase a frictional force against the laundry to facilitate removing dirt of the laundry. In the embodiment of the present invention, the rubbing ridges 428 are formed on the inner surface of the auxiliary washing unit 420 so as to be higher than the neighboring inner surface. In the embodiment of the present invention, the plurality of rubbing ridges 428 may be formed in parallel. However, shapes and arrangement of the rubbing ridges 428 are not particularly restricted.

The auxiliary washing unit 420 may include an auxiliary drain port 430.

The auxiliary drain port 430 is provided such that wash water used for the washing in the auxiliary washing space 420*a* is drained. The auxiliary drain port 430 is provided in a hole shape, and has a separate opening/closing member. The auxiliary drain port 430 may be disposed at the bottom portion 424 of the auxiliary washing space 420*a*. In the embodiment of the present invention, the auxiliary drain port 430 is provided for the lateral portion 426 of the unit body 422. When the auxiliary washing unit 420 is pivoted, the auxiliary washing space 420*a* is inclined, and the auxiliary drain port 430 allows the wash water stored in the auxiliary washing unit 420 to be drained.

A circumference 426*b* of the auxiliary drain port 430 may be formed to be lower than an upper end 426*a* of the unit body 422. That is, the auxiliary drain port 430 may be formed in a portion that is recessed from the upper end of the unit body 422. A shape of the auxiliary drain port 430 is not limited to this shape. Thus, any shape is possible as long as the wash water stored in the auxiliary washing space 420*a* can be drained when the auxiliary washing unit 420 is inclined.

The auxiliary washing unit 420 may include a seat flange 432.

The seat flange 432 is formed to extend outward from an upper end of the auxiliary washing unit 420 so as to be able to be placed on the first cabinet 110. That is, the seat flange 432 may be provided in a flanged shape along the upper end of the unit body 422.

An inner side of the first opening 111 of the first cabinet 110 may be provided with a seat 111*a* that is formed to protrude along a circumference of the first opening 111. The seat flange 432 is provided to be able to be placed on the seat 111*a*. The seat flange 432 is placed on the seat 111*a*, and thereby the auxiliary washing unit 420 can be placed on the first cabinet 110.

The water may be fed to the main washing space 130*a* and the auxiliary washing space 420*a* by the feed unit 180.

An inner upper portion of the first cabinet 110 is provided with an automatic detergent supply unit 440 that automatically supplies liquid detergent and fabric softener into the first tub 120. The liquid detergent and the fabric softener contained in the automatic detergent supply unit 440 are supplied into the first tub 120 via the automatic detergent supply unit 440 by the feed unit 180 connected to the first tub 120 together with the wash water.

A door handle 452 and an auxiliary handle 454 are respectively provided in the fronts of the door 410 and the auxiliary washing unit 420 so as to be able to pivot the door 410 and the auxiliary washing unit 420. The door handle 452 is operated to pivot the door 410, and the auxiliary handle 454 is operated to pivot the auxiliary washing unit 420. Alternatively, both the auxiliary washing unit 420 and the door 410 may be pivoted.

The water may be fed to the auxiliary washing unit 420 by an auxiliary feed port (not shown). The auxiliary feed port may be provided to communicate with a feed pipe that is formed to branch off from the feed unit 180. Thereby, the water can be fed to the auxiliary washing space 420*a*.

The auxiliary washing unit 420 is provided with a wash water inlet 434 in correspondence with the auxiliary feed port such that the wash water fed from the auxiliary feed port (not shown) can be introduced into the auxiliary washing unit 420. A circumference 426*c* of the wash water inlet 434 is formed to be lower than the upper end 426*a* of the unit body 422. That is, the wash water inlet 434 may be formed in a portion that is recessed from the upper end of the unit body 422. However, a shape of the wash water inlet 434 is not limited to this shape. Any shape is possible as long as the wash water can be introduced into the auxiliary washing space 420*a* when introduced through the auxiliary feed port without interference with the unit body 422.

According to the embodiments of the present invention, the washing machine can provide a clutch unit having a simple structure.

According to the embodiments of the present invention, a volume of the clutch unit is reduced, and thus a volume of the entire washing machine can be reduced.

According to the embodiments of the present invention, a washing space can be changed according to a quantity of laundry, and thus the washing machine can reduce consumption of wash water and power consumption.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A washing machine comprising:
a main body;
a tub disposed in the main body so as to store wash water;
a drum rotatably disposed in the tub;
a pulsator rotatably disposed in the drum;
a drive unit provided below the tub so as to generate power for rotating the drum and the pulsator; and
a clutch unit disposed between the drive unit and the drum,
wherein the clutch unit includes:
an outer shaft that is connected to the drum at an upper side thereof and rotates the drum;
an inner shaft that is located in the outer shaft, is connected to the pulsator at an upper side thereof, and rotates the pulsator; and
a one-way bearing that is installed between the inner shaft and the outer shaft, and
the one-way bearing selectively transmits a rotating force from the outer shaft to the inner shaft according to a rotating direction of the outer shaft.

2. The washing machine according to claim 1, wherein the one-way bearing is provided such that:
only any one of the inner shaft and the outer shaft is rotated when the drive unit is rotated in a first direction; and
both the inner shaft and the outer shaft are rotated when the drive unit is rotated in a second direction.

3. The washing machine according to claim 1, wherein the outer shaft is connected to the drive unit at a lower end thereof.

4. The washing machine according to claim 3, wherein the inner shaft comes into contact with the one-way bearing and is supplied with the rotating force from the one-way bearing.

5. The washing machine according to claim 1, wherein:
the clutch unit further includes a clutch housing having an internal space; and
the inner shaft and the outer shaft are located in the clutch housing.

6. The washing machine according to claim 5, wherein the clutch unit further includes at least one ball bearing installed between the clutch housing and the outer shaft.

7. A washing machine comprising:
a main body;
a tub disposed in the main body so as to store wash water;
a drum rotatably disposed in the tub;
a pulsator rotatably disposed in the drum;
a drive unit provided below the tub so as to generate power for rotating the drum and the pulsator; and
a clutch unit disposed between the drive unit and the drum,
wherein the clutch unit includes:
an outer shaft that rotates the drum;
an inner shaft that is located in the outer shaft and rotates the pulsator; and
a one-way bearing that is installed between the inner shaft and the outer shaft, and
the one-way bearing transmits or blocks a rotating force of the drive unit to the inner shaft according to a rotating direction of the outer shaft.

8. The washing machine according to claim 7, wherein the outer shaft is connected to the drum at an upper side thereof and to the drive unit at a lower side thereof.

9. The washing machine according to claim 7, wherein the one-way bearing does not transmit a rotating force of the outer shaft to the inner shaft when the drive unit is rotated in a first direction, and transmits the rotating force of the outer shaft to the inner shaft when the drive unit is rotated in a second direction.

10. A washing machine comprising:
a main body including a plurality of cabinets;
a plurality of tubs including a first tub and a second tub, the first tub and the second tub respectively provided in the plurality of cabinets so as to store wash water;
a plurality of drums including a first drum and a second drum, the first drum and the second drum rotatably disposed in the plurality of tubs, respectively;
a pulsator rotatably disposed in any one of the plurality of drums;
a drive unit configured to generate power for rotating the any one of the plurality of drums and the pulsator; and
a clutch unit configured to selectively transmit the power from the drive unit to the any one of the plurality of drums and the pulsator,
wherein the clutch unit includes:
a plurality of rotating shafts, the plurality of rotating shafts including:

an outer shaft that is connected to the any one of the plurality of drums and configured to rotate the any one of the plurality of drums, and an inner shaft located inside the outer shaft, that is connected to the pulsator, and configured to rotate the pulsator; and a one-way bearing that transmits a rotating force from any one of the plurality of rotating shafts to an other one of the plurality of rotating shafts according to a rotating direction of the any one of the plurality of rotating shafts.

11. The washing machine according to claim 10, wherein the one-way bearing is provided such that:

the plurality of rotating shafts are rotated together when the drive unit is rotated in a first direction; and only the any one of the rotating shafts is rotated when the drive unit is rotated in a second direction opposite to the first direction.

12. The washing machine according to claim 10, wherein the one-way bearing is disposed between the inner shaft and the outer shaft.

13. The washing machine according to claim 10, wherein:

the outer shaft is connected to the drive unit so as to be supplied with the power from the drive unit; and the one-way bearing transmits the rotating force from the outer shaft to the inner shaft according to a rotating direction of the drive unit.

14. The washing machine according to claim 13, wherein the one-way bearing is provided such that:

only the outer shaft is rotated when the drive unit is rotated in a first direction; and both the outer shaft and the inner shaft are rotated when the drive unit is rotated in a second direction opposite to the first direction.

15. The washing machine according to claim 14, wherein the washing machine is provided to operate in a washing mode in which the drive unit is rotated in the first direction or the second direction, and in a water extracting mode in which the drive unit is rotated in the second direction.

16. The washing machine according to claim 10, wherein the plurality of cabinets include:

an upper cabinet in which the first tub and the first drum are disposed and at an upper portion of which a first opening is formed for withdrawing laundry; and a lower cabinet in which the second tub and the second drum are disposed, which is provided under the upper cabinet, and in a lateral portion of which a second opening is formed for withdrawing laundry.

17. The washing machine according to claim 16, further comprising a vibration reduction unit that has at least one elastic unit so as to attenuate vibration and provided between the upper cabinet and the lower cabinet.

18. The washing machine according to claim 17, wherein the at least one elastic unit includes:

a support part connected to a lower portion of the upper cabinet; and an elastic part that is provided at a lower portion of the support part and is elastically supported on an upper surface of the lower cabinet.

19. The washing machine according to claim 16, wherein the upper cabinet further includes a reflector that is provided adjacent to the first opening to provide a view of the laundry in the first drum from outside of the upper cabinet.

20. The washing machine according to claim 10, further comprising a laundry tray that is provided on the main body for placing laundry thereon.

21. The washing machine according to claim 20, wherein the laundry tray is provided to be able to be withdrawn with respect to the main body.

* * * * *